US010363994B2

(12) United States Patent
Levin

(10) Patent No.: US 10,363,994 B2
(45) Date of Patent: Jul. 30, 2019

(54) ONE-SIDED CANTILEVERED WATERCRAFT CANOPY

(71) Applicant: Designer Direct, Inc., Des Plaines, IL (US)

(72) Inventor: Kerry Levin, Des Plaines, IL (US)

(73) Assignee: Designer Direct, Inc., Des Plaines, IL (US)

( * ) Notice: Subject to any disclaimer, the term of this patent is extended or adjusted under 35 U.S.C. 154(b) by 0 days.

(21) Appl. No.: 15/686,095

(22) Filed: Aug. 24, 2017

(65) Prior Publication Data

US 2017/0349242 A1 Dec. 7, 2017

Related U.S. Application Data

(63) Continuation of application No. 15/186,334, filed on Jun. 17, 2016, now Pat. No. 9,776,687.

(Continued)

(51) Int. Cl.
*B63B 17/02* (2006.01)
*E04H 15/18* (2006.01)

(Continued)

(52) U.S. Cl.
CPC ..... *B63B 17/02* (2013.01); *E04H 15/06* (2013.01); *E04H 15/18* (2013.01); *E04H 15/36* (2013.01);

(Continued)

(58) Field of Classification Search
CPC ..... B63B 17/02; B63B 2737/00; B63B 2017/026

(Continued)

(56) References Cited

U.S. PATENT DOCUMENTS 2,425,079 A 8/1947 Billig
2,708,346 A 5/1955 Smith (Continued)

FOREIGN PATENT DOCUMENTS

CA 1289436 9/1991
CA 02088948 8/1994

(Continued)

OTHER PUBLICATIONS

Pier-port 4, Youtube Video, https://www.youtube.com/watch?v=ZFcdmitfB1Q, Dec. 26, 2014 (Includes dated web page print followed by page of still images summarizing video)(Grace Period Disclosure).

(Continued)

*Primary Examiner* — Noah Chandler Hawk
(74) *Attorney, Agent, or Firm* — Steven L. Fisher-Stawinski

(57) ABSTRACT

A cantilevered canopy structure includes at least one vertical support having a first and second upper support joint. The structure further includes at least one first and second horizontal support. The first horizontal support is affixed to the vertical supports at the first upper support joint. The second horizontal support is affixed to the vertical supports at the second upper support joint. The structure further includes cantilever supports. The cantilever support is affixed to the first and second horizontal supports. The structure further includes at least one horizontal frame member. The horizontal frame member is affixed to the cantilever supports at a cantilever frame joint. The first upper support joint is located higher than the second upper support joint. The first upper support joint and second upper support joints are distal, in opposing directions, from the vertical support.

17 Claims, 9 Drawing Sheets

Related U.S. Application Data

(60) Provisional application No. 62/181,979, filed on Jun. 19, 2015.

(51) Int. Cl.

| | |
|---|---|
| ***E04H 15/54*** | (2006.01) |
| ***E04H 15/06*** | (2006.01) |
| ***E04H 15/36*** | (2006.01) |
| *E04H 15/58* | (2006.01) |
| *E04H 15/04* | (2006.01) |

(52) U.S. Cl.
CPC ..... *E04H 15/54* (2013.01); *B63B 2017/026* (2013.01); *B63B 2737/00* (2013.01); *E04H 15/04* (2013.01); *E04H 15/58* (2013.01)

(58) Field of Classification Search
USPC ..... 135/160, 97, 906, 908, 155, 157, 158, 135/159, 94, 153, 154; 52/66; 114/361, 114/263
See application file for complete search history.

(56) References Cited

U.S. PATENT DOCUMENTS

| | | | |
|---|---|---|---|
| 2,845,078 | A | 7/1958 | Singleton |
| 3,030,973 | A | 4/1959 | Janda |
| 3,023,732 | A | 5/1959 | Everett |
| D186,656 | S | 11/1959 | Vetare |
| 2,930,387 | A | 2/1960 | Streich |
| D194,584 | S | 2/1963 | Weber |
| 3,083,540 | A | 4/1963 | Smith |
| 3,242,620 | A | 3/1966 | Kaiser |
| 3,307,514 | A | 3/1967 | Young |
| 3,410,036 | A | 11/1968 | Franz |
| 3,869,836 | A | 3/1975 | Allen |
| 4,312,157 | A | 1/1982 | Hertel |
| 4,363,284 | A | 12/1982 | Monroe |
| 4,683,901 | A | 8/1987 | Mitchell |
| 4,825,890 | A | 5/1989 | Castlebury |
| 4,890,599 | A | 1/1990 | Eiden |
| 4,898,198 | A | 2/1990 | Castlebury |
| 5,086,799 | A | 2/1992 | Lumbleau |
| 5,152,109 | A | 10/1992 | Boers |
| 5,185,972 | A | 2/1993 | Markiewicz |
| 5,314,377 | A | 5/1994 | Pelosi |
| 5,331,917 | A | 7/1994 | Magers |
| 5,425,327 | A | 6/1995 | Zirkelbach |
| 5,445,487 | A | 8/1995 | Koscinski, Jr. |
| D363,790 | S | 10/1995 | Boyd |
| 5,520,139 | A | 5/1996 | King |
| 5,573,026 | A | 11/1996 | Griffith |
| 5,575,301 | A | 11/1996 | Bolton |
| 5,697,320 | A | 12/1997 | Murray |
| 5,709,501 | A | 1/1998 | Elbers |
| D403,081 | S | 12/1998 | Luzzardi |
| 5,904,114 | A | 5/1999 | Wright |
| D412,993 | S | 8/1999 | Chipman |
| 5,979,125 | A | 11/1999 | Guillet |
| D420,812 | S | 2/2000 | Chipman |
| 6,032,433 | A | 3/2000 | Hatziathanasiou |
| 6,073,587 | A | 6/2000 | Hill |
| 6,360,492 | B1 | 3/2002 | Ross |
| D468,837 | S | 1/2003 | Shilling |
| 6,536,992 | B1 | 3/2003 | Floe |
| 6,688,252 | B1 | 2/2004 | Caravella |
| 6,691,723 | B2 | 2/2004 | Godbersen |
| 6,976,806 | B2 | 12/2005 | Edson |
| 7,001,104 | B2 | 2/2006 | Edson |
| 7,055,538 | B2 | 6/2006 | Deng |
| D530,022 | S | 10/2006 | Haymann |
| 7,353,769 | B2 | 4/2008 | Unrast |
| 7,389,785 | B2 | 6/2008 | Loudermilk |
| 7,392,816 | B2 | 7/2008 | Porter |
| 7,401,569 | B2 | 7/2008 | Jones |
| 7,527,014 | B2 | 5/2009 | Hey |
| D595,865 | S | 7/2009 | Magnusson |
| 7,555,994 | B1 | 7/2009 | Amall |
| 7,669,542 | B2 | 3/2010 | Donahue |
| 7,814,723 | B2 | 10/2010 | VanElverdinghe |
| 7,913,710 | B2 | 3/2011 | Bougioukos |
| 7,958,839 | B2 | 6/2011 | Donahue |
| D643,937 | S | 8/2011 | Boesch |
| 8,286,651 | B1 | 10/2012 | Maffett |
| 8,387,318 | B2 | 3/2013 | Kaufman |
| 8,555,910 | B2 | 10/2013 | Webster |
| 8,667,908 | B2 | 3/2014 | Martin |
| 8,783,276 | B2 | 7/2014 | Skrzynski |
| 8,789,549 | B1 | 7/2014 | Barnes |
| 8,854,794 | B2 | 10/2014 | Van Straten |
| 8,857,366 | B2 | 10/2014 | Russikoff |
| 8,944,399 | B2 | 3/2015 | Sutherland |
| 9,153,718 | B2 | 10/2015 | Richardson |
| 9,216,798 | B2 | 12/2015 | Kent |
| 9,272,754 | B1 | 3/2016 | Craig |
| 9,345,941 | B1 | 5/2016 | Celedon |
| 9,404,281 | B1 | 8/2016 | Donnay |
| 9,556,640 | B2 | 1/2017 | Levin |
| 9,926,720 | B2 | 3/2018 | Huang |
| 2003/0056818 | A1 | 3/2003 | Connelly |
| 2003/0131539 | A1 | 7/2003 | Burford |
| 2003/0188775 | A1 | 10/2003 | Connelly |
| 2004/0226594 | A1 | 11/2004 | Connelly |
| 2005/0262777 | A1 | 12/2005 | Dalo |
| 2007/0068634 | A1 | 3/2007 | Unrast |
| 2007/0295379 | A1 | 12/2007 | Basta |
| 2007/0295384 | A1 | 12/2007 | Uozumi |
| 2008/0168938 | A1 | 7/2008 | Impey |
| 2009/0173709 | A1 | 7/2009 | Spitsbergen |
| 2010/0051078 | A1 | 3/2010 | Sy-Facunda |
| 2011/0135399 | A1 | 6/2011 | McKay |
| 2014/0026804 | A1 | 1/2014 | Templeton |
| 2014/0331569 | A1 | 11/2014 | Spearn |
| 2015/0000725 | A1 | 1/2015 | Reilly |
| 2015/0308143 | A1 | 10/2015 | Levin |
| 2016/0129975 | A1 | 5/2016 | Craig |
| 2016/0289989 | A1 | 10/2016 | Creagh |
| 2016/0368571 | A1 | 12/2016 | Levin |
| 2017/0096834 | A1 | 4/2017 | Levin |
| 2017/0284081 | A1 | 10/2017 | Craig |

FOREIGN PATENT DOCUMENTS

| | | | |
|---|---|---|---|
| CN | 204112218 | | 1/2015 |
| DE | 102006019755 | | 4/2006 |
| EP | 3147428 | A1 | 3/2017 |
| FR | 1520912 | A | 3/1968 |
| FR | 2142243 | A5 | 1/1973 |
| FR | 2169482 | A5 | 9/1973 |
| WO | WO2011157969 | | 6/2011 |
| WO | WO2011140557 | | 11/2011 |

OTHER PUBLICATIONS

Pier-port 6, Youtube Video, https://www.youtube.com/watch?v=p4oxEgZDreQ, Apr. 6, 2015 (Includes dated web page print followed by page of still images summarizing video)(Grace Period Disclosure).

Pier-port 6, Youtube Video, https://www.youtube.com/watch?v=-KR4u5i6ego, Apr. 7, 2015 (Includes dated web page print followed by page of still images summarizing video)(Grace Period Disclosure).

Pier-Port|Cantilevered Boat Canopy, Pier-port.com, The Internet Wayback Machine, May 9, 2015, https://web.archive.org/web/20150509035441/http://pier-port.com/(Prints and screenshots of dated snapshot)(Grace Period Disclosure).

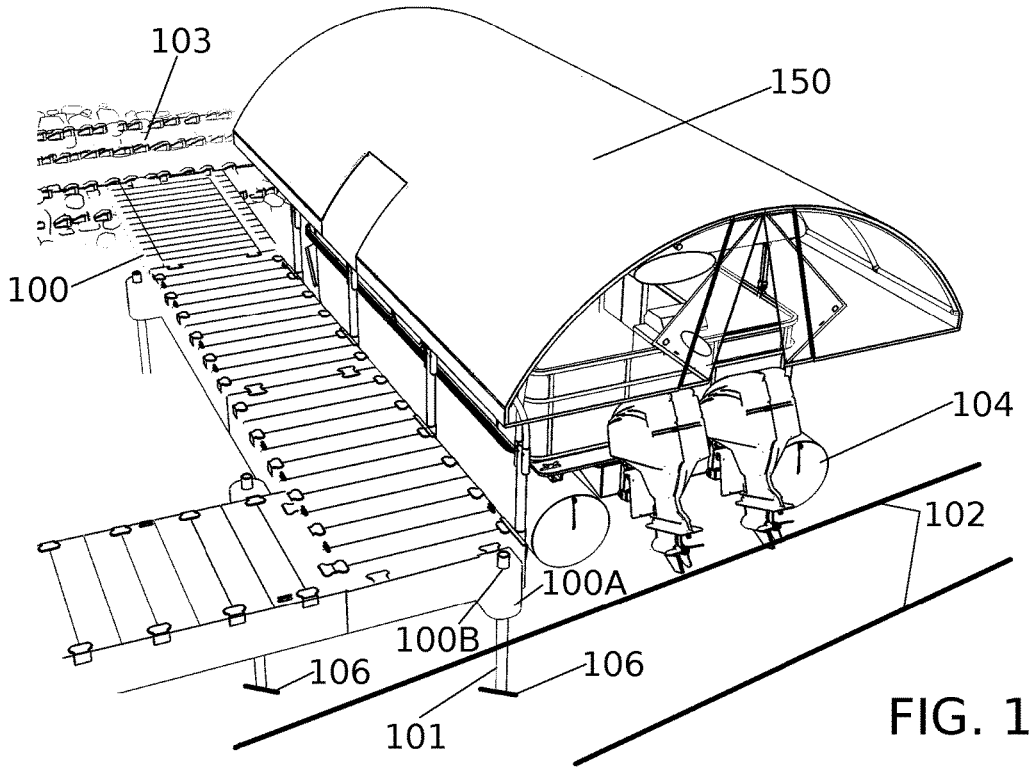
FIG. 1
FIG. 2
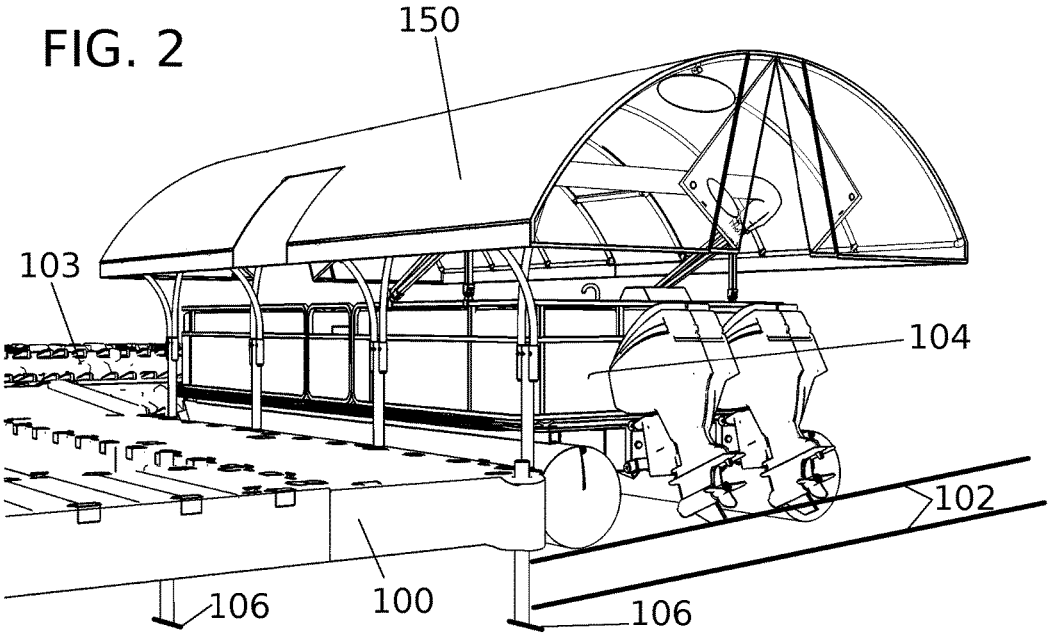

ONE-SIDED CANTILEVERED WATERCRAFT CANOPY

CROSS-REFERENCE TO RELATED APPLICATIONS

This application claims priority to co-pending U.S. patent application Ser. No. 15/186,334, filed on Jun. 17, 2016, which claims the benefit of U.S. Provisional Application No. 62/181,979, filed on Jun. 19, 2015, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to protective covers and shelters for watercraft and in particular to cantilever covers including canopy frames. Boaters who moor their boats to piers are universally faced with the task of repeatedly covering and then uncovering their watercraft between storage and use configurations. While seemingly simple, this task can be daunting and can greatly diminish enjoyment of the boating experience.

Individual covers exist for most watercraft, but have to be manually taken on and off with a combination of zippers, snaps, and center poles. This task can be time consuming and physically demanding, and, for people with dexterity disabilities, virtually impossible. Often times, boaters skip boating altogether because of the difficulty associated with manual covers.

SUMMARY OF THE INVENTION

A cantilevered canopy structure includes at least one vertical support. Each vertical support includes a first upper support joint and a second upper support joint. The cantilevered canopy structure further includes at least one first horizontal support and at least one second horizontal support. The first horizontal support is affixed to at least one of the vertical supports at the first upper support joint. The second horizontal support is affixed to at least one of the vertical supports at the second upper support joint. The cantilevered canopy structure further includes at least one cantilever support. The cantilever support is affixed to at least one of the first horizontal supports and at least one of the second horizontal supports. The cantilevered canopy structure further includes at least one horizontal frame member. The horizontal frame member is affixed to at least one of the cantilever supports at a cantilever frame joint. The first upper support joint is located higher than the second upper support joint. The first upper support joint is distal, in a first direction, from an axial line of the at least one vertical support. The second upper support joint is distal, in a second direction, from the axial line. The first direction and the second direction are opposed. The horizontal frame member is located farther distally, in the first direction from the axial line than the first horizontal support.

In another aspect, a vertical support for a cantilevered canopy includes a vertical member, a first vertical cantilever member, and a second vertical cantilever member. The vertical member includes a vertical member upper joint. The first vertical cantilever member and the second vertical cantilever member are affixed to the vertical member at the vertical member upper joint. The first vertical cantilever member includes a first upper support joint. The second vertical cantilever member includes a second upper support joint. The first vertical cantilever member extends distally, in a first direction, from an axial line of the at least one vertical support. The second vertical cantilever member extends distally, in a second direction, from the axial line. The first direction and the second direction are opposed.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 is an elevated front left perspective scene view of a one-sided cantilevered watercraft canopy installed on a dock, in accordance with at least one embodiment of the present invention.

FIG. 2 is a front left perspective scene view of a one-sided cantilevered watercraft canopy installed on a dock, in accordance with at least one embodiment of the present invention.

DETAILED DESCRIPTION OF THE INVENTION

Figure 3:
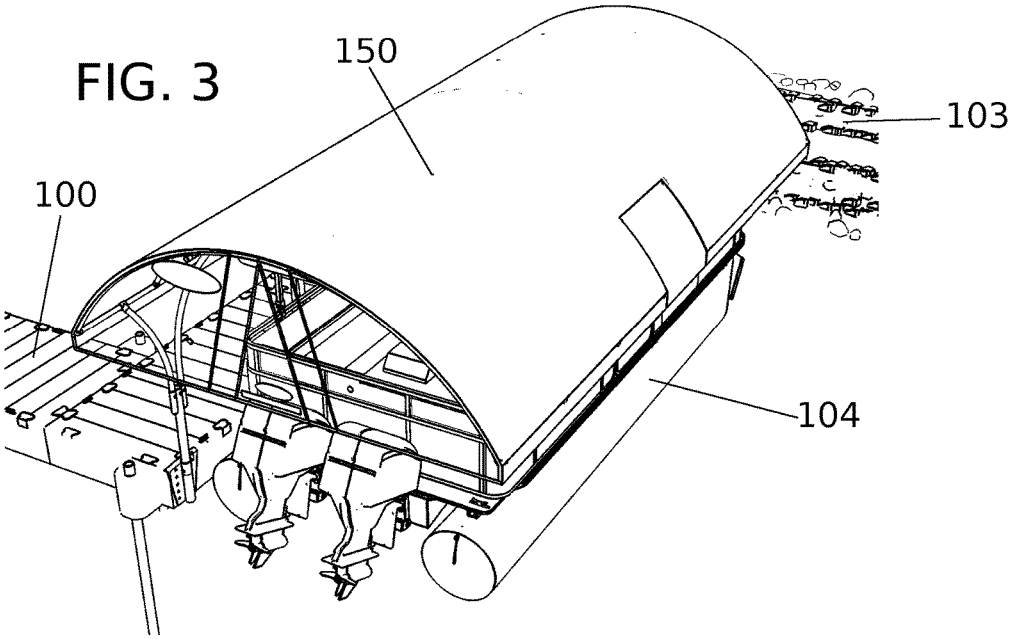
FIG. 3 is an elevated front right perspective scene view of a one-sided cantilevered watercraft canopy installed on a dock, in accordance with at least one embodiment of the present invention.
Figure 4:
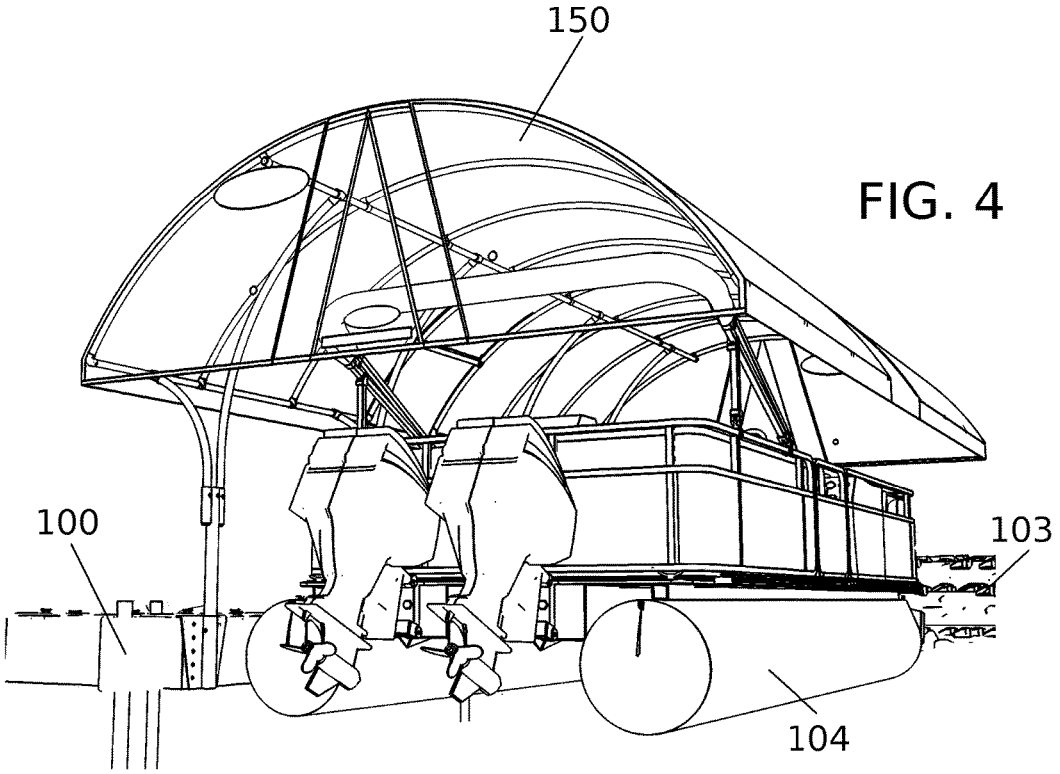
FIG. 4 is a lowered front left perspective scene view of a one-sided cantilevered watercraft canopy installed on a dock, in accordance with at least one embodiment of the present invention.

Referring now to the invention in more detail, the invention is directed to a one-sided cantilevered watercraft canopy. As shown in FIGS. 1-4, the environment of the depicted embodiments is installation on a dock 100 or pier such that a mooring area to one side of the dock 100 is covered by the canopy structure 150. As depicted in FIGS. 1-4, defined within the environment are the water level 102 (the water level 102 is represented by a pair of parallel oblique lines, which define a plane within the perspective of the figures), the shore 103, and the water body bed 106 (the water body bed 106 is represented by short oblique line segments located at the base of the guide poles 101; the water body bed 106 may be understood to extend in all directions under the body of water in the locale of installation). In general, the water body bed 106 may refer to the floor of any body of water in which the user wishes to moor watercraft—for example, a lake bed, riverbed, pond bed, seabed, etc., including the bed of an artificial body of water. While an aspect of the depicted embodiment, the presence of a dock 100 or even a body of water are not required to practice the invention, which may be installed over a mooring area having no walking access (for example, using the auger pole support option of FIG. 13), or over a location on dry land or otherwise with no water at all. The invention may provide covered mooring for large exemplary watercraft 104, for example the pontoon boat shown, as well as small exemplary watercraft such as canoes, kayaks, or powered personal watercraft, or for any other type of watercraft moorable at a dock 100.

In the depicted embodiment, the dock 100 is a floating dock. Currently commercially available floating docks are characterized by a system of modular configurable dock guides 100A, which form a bracket attached to the outer edge of the floating dock 100. Each dock guide 100A is pierced by a floating dock guide hole 100B. Some commercially available floating docks dispense with the floating dock guide bracket in favor of piercing the dock with the guide hole directly; in this case, the invention is installed in the provided guide holes. In ordinary operation, floating dock guide poles 101 are augured to the water body bed 106 and configured to pass through the guide holes 100B just above the water level 102. The floating dock 100 is thus allowed to move freely up and down as the water level 102 changes over time, but is restricted in its horizontal motion by the guide poles 101.

Figure 9:
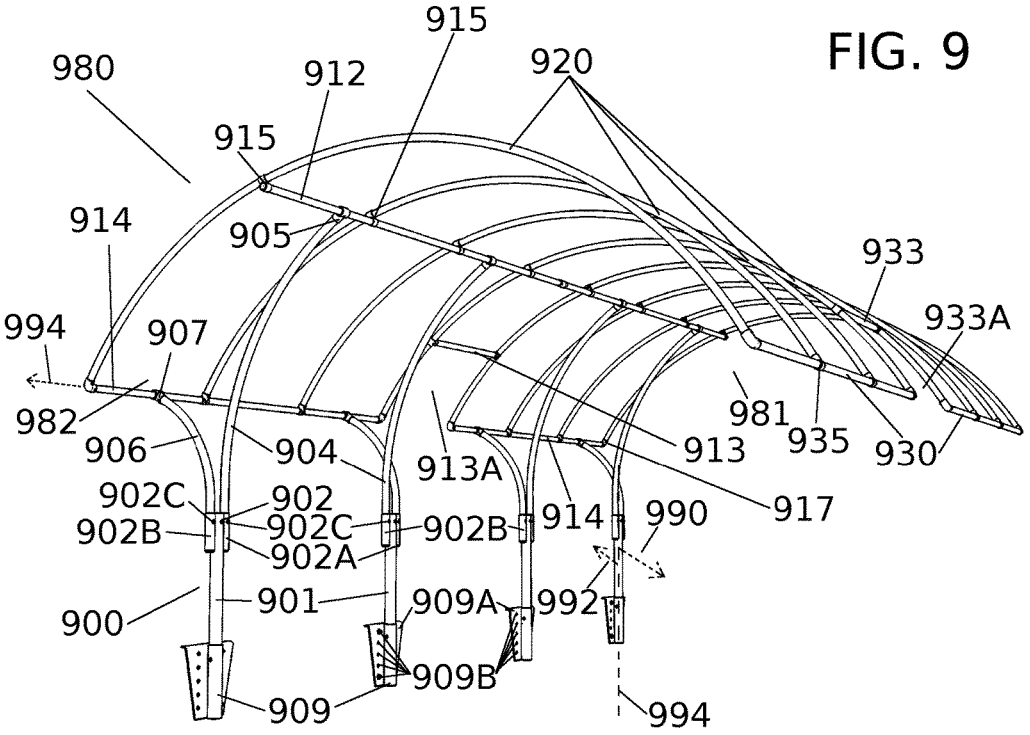
FIG. 9 is a front right perspective view of a canopy frame, in accordance with at least one embodiment of the invention.
Figure 10:
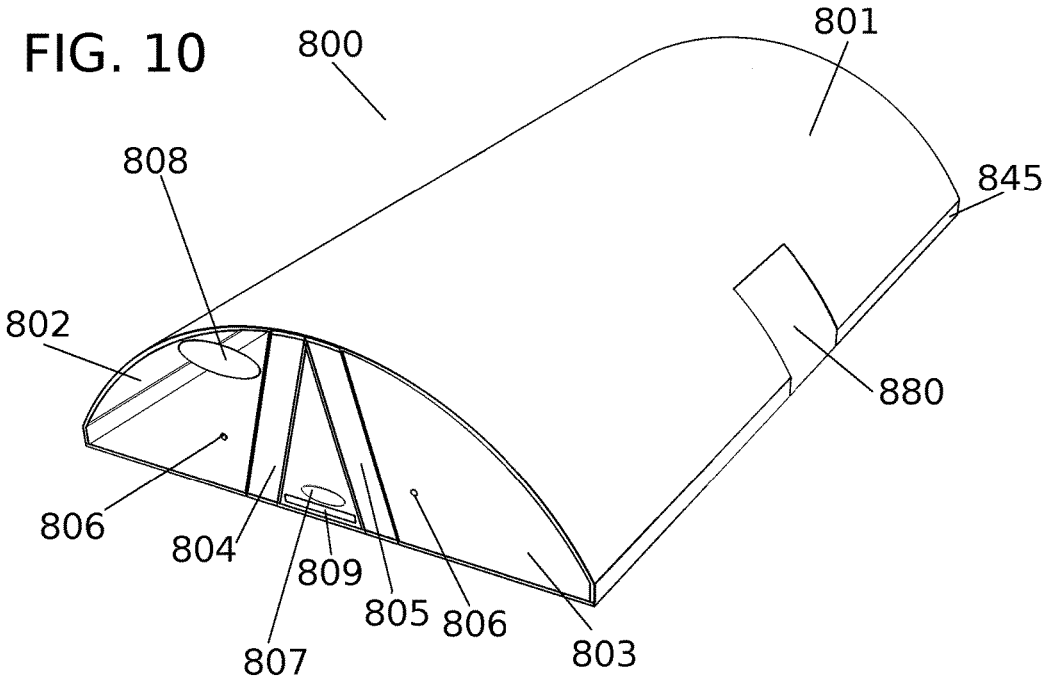
FIG. 10 is an elevated front right perspective view of a canopy cover with rollable door flaps closed and front door flaps closed, in accordance with at least one embodiment of the invention.
Figure 11:
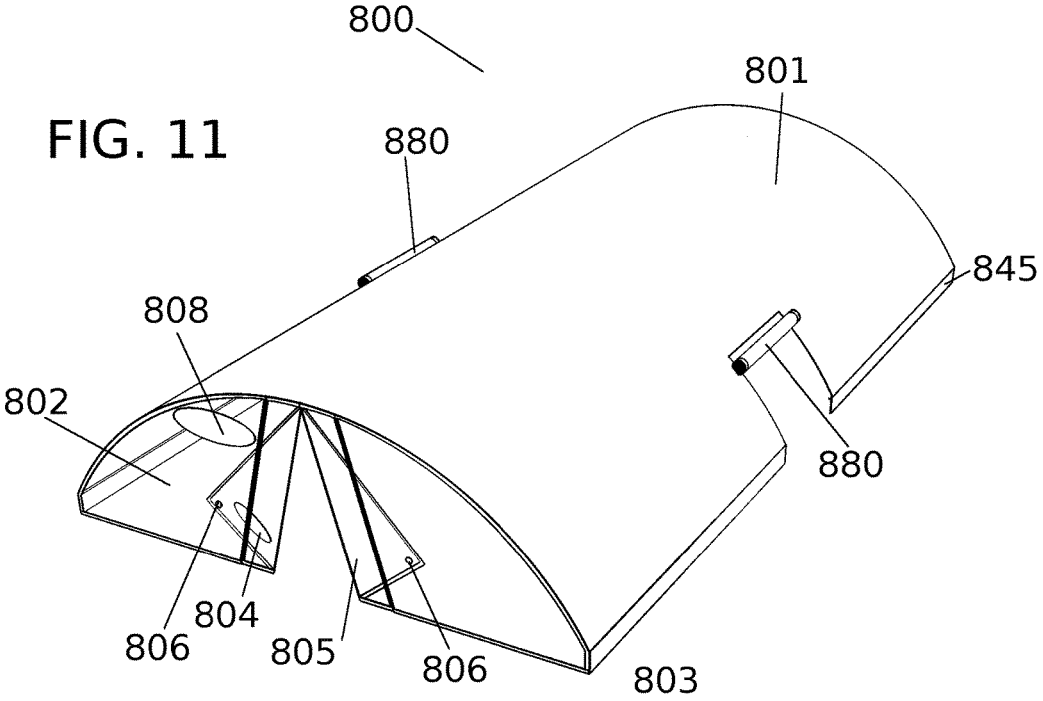
FIG. 11 is an elevated front right perspective view of a canopy cover with rollable door flaps open and front door flaps open, in accordance with at least one embodiment of the invention.

Referring now to FIG. 9, in various embodiments, the present invention includes vertical supports 900, each including a first upper support joint 905 and a second upper support joint 907. The vertical supports 900 are may be affixed to a mounting surface, generally either the dock 100 or the water body bed 106, by any of several provided vertical support mounting means for mounting the vertical supports 900 to the mounting surface. In the depicted embodiment, a bracket 909 is affixed to the lower end of the vertical support 900 and attached to the mounting surface via fasteners, as described in further detail below.

Figure 13:
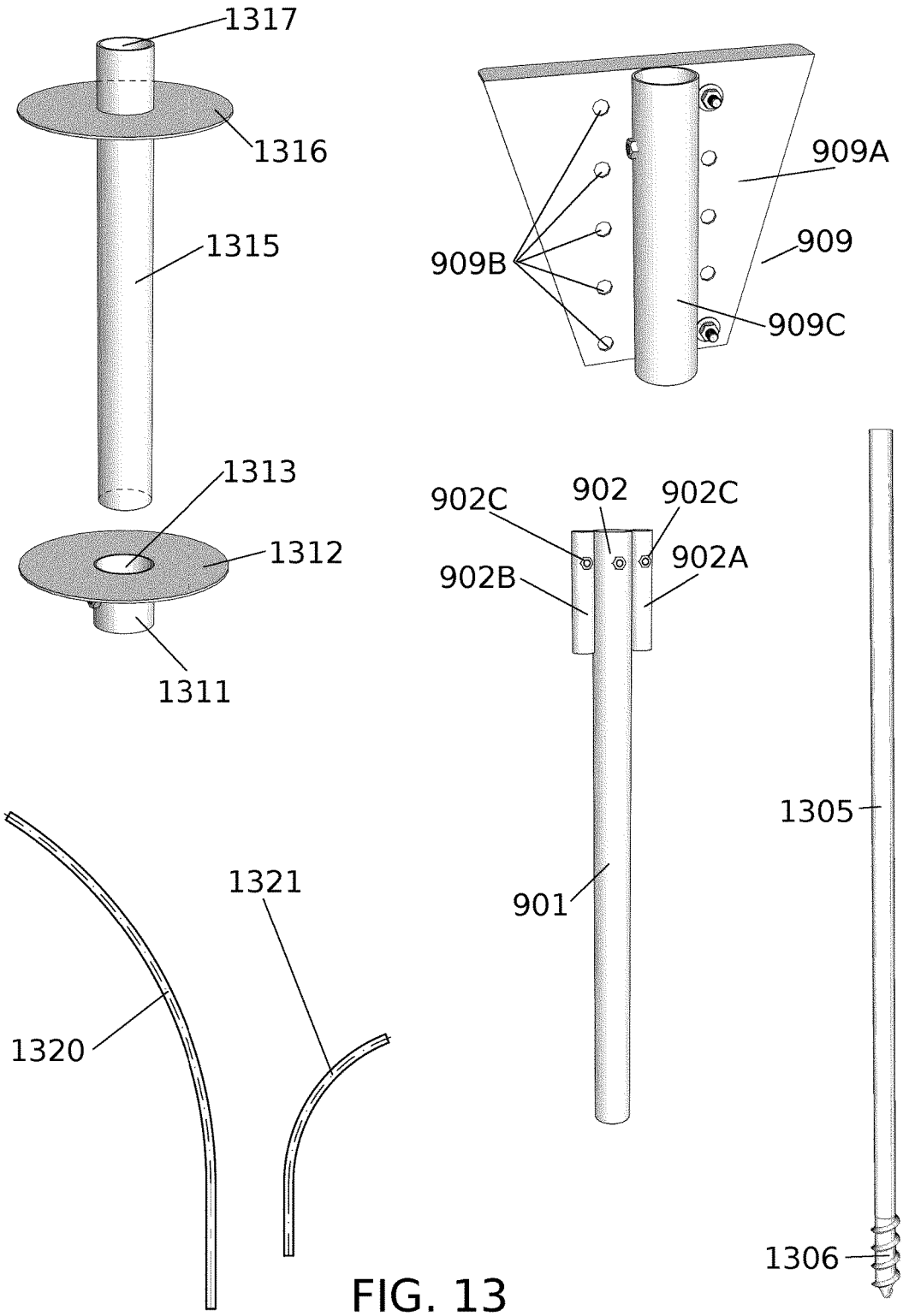
FIG. 13 is a front view of various components, in isolation, for a canopy, in accordance with at least one embodiment of the invention.

In an embodiment, where a floating dock 100 is present, the mounting surface is provided by adding extra dock guides 100A to the dock 100. FIG. 13 depicts the how bottom end 1317 of the vertical support 900 may fitted with an insertion extension 1315 and rigid flange 1316, to be inserted into a vertical support socket 1313. The vertical support socket 1313 is located at the top end of an insertion member 1311, which fits inside the guide hole 100B. Near its top, the insertion member 1311 is surrounded by and rigidly affixed to a rigid stop disc flange 1312, which is larger in diameter than the guide hole 100B. Thus, the insertion member 1311 and stop disc flange 1312, together secure the vertical support 900 with the insertion member 1311 resting within and the stop disc flange 1312 resting above the guide hole 600B.

The embodiment of FIG. 9 provides for attaching the vertical supports 900 to any dock 100, whether fixed, floating, or otherwise (i.e., at least one vertical support 900 may be affixed to the dock 100 by a bracket 909). FIG. 13 provides a close-up view of the bracket 909. In such a configuration, the bottom end of each vertical support 900 is inserted into a bracket vertical support tube 909C, where it may be secured by a vertical support socket fastener (for example, an installed Allen bolt) or allowed to rest by gravity and/or friction. The bracket vertical support tube 909C is affixed to a bracket flat 909A, which is affixed to the side of the dock 100 by fastening through or around the dock edge via fastener holes 909B. Bolts, screws, pins, pegs, nails, and the like may be passed through the fastener holes 909B to secure the bracket 909 to the dock 100 or other mounting surface.

Another alternative embodiment provides for attaching the vertical supports 900 to an auger pole 1305 (shown in FIG. 13). The base of the auger pole 1305 is fitted with an auger 1306, which is driven into the water body bed 106.

This allows embodiments of the invention to be practiced in the absence of a suitably stable dock 100 and in the absence of any dock or pier at all, for example in an open water mooring area.

Referring now to the canopy frame of FIG. 9, the vertical supports 900 support the upper portions of the canopy frame. In the depicted embodiment, the vertical supports 900 support the entire upper portion of the canopy frame alone—that is, without any cross-bracing or other elements that would obstruct access to the walking space on the dock 100 or in watercraft mooring area on the water, including where an occupant of the watercraft would need to move about, as shown, for example, in FIG. 4.

Referring still to the embodiment depicted in FIG. 9, at least one first horizontal support 912 is affixed to the vertical supports 900 at the first upper support joints 905, and at least one second horizontal support 914 is affixed to the vertical supports 900 at the second upper support joints 907. As shown, distinct second horizontal supports 914 can be separated by an entry gap 913A, which forms an ingress/egress to the canopy. The frame includes at least one cantilever support 920, which is affixed to at least one of the first horizontal supports 912 at a first cantilever support joint 915 and at least one of the second horizontal supports 914 at a second cantilever support joint 917. The cantilever supports 920 may be arch-shaped as shown, or may be constructed with hard lines and angles. More particularly, the cantilever supports 920 may be shaped so as to define an arc that intersects the first horizontal support 912, the second horizontal support 914, and the cantilever frame member 930. Such an arc may be understood as downwardly concave and lacking any inflection points, as shown. As used herein, "downwardly concave" means that the outside edge, relative to the arc, of any downwardly concave element is oriented vertically higher than the inside edge, relative to the arc. Equivalently, as shown in FIG. 9, the arch-shaped cantilever supports 920 may be understood to define a barrel vault 980; that is, the arc defined by the cantilever supports may be extruded along the dimension defined by the first horizontal support 912. The defined barrel vault 980 may be understood to have a first barrel vault end 981 and a second barrel vault end 982, which may be understood as the flat and vertical faces at either end of the extruded dimension of the barrel vault 980, which, in the embodiment of FIG. 9, are unobstructed by any frame members. Further, the defined barrel vault may be positioned distally to the dock 100 in the first direction 990. The cantilever support 920 is affixed to at least one of the first horizontal supports 912 and at least one of the second horizontal supports 914. The frame further includes at least one horizontal frame member 930. The horizontal frame member is affixed to at least one of the cantilever supports 920 at a cantilever frame joint 935. As used herein with reference to the barrel vault 980, the term "transverse" means oriented along the dimension in which the cantilever supports 920 are aligned, or the dimension in which the barrel vault 980 is arched, and "longitudinal" means orthogonal to the planes defined by the cantilever supports 920.

In the depicted embodiment, the first upper support joint 905 is located higher than the second upper support joint 907, as shown. The first upper support joint is positioned distally, in a first direction 990, from an axial line 994 of the vertical support 900. The second upper support joint is positioned distally, in a second direction 992, from the axial line 994. The first direction 990 and the second direct 992 are opposed, which, as used herein, means that the first direction 990 and second direction 992 are approximately 180° apart about an axis of rotational symmetry, such as the axial line 994. It should be noted, however, that opposed directions, as used herein, allows for bending and shifting under mechanical stress, manufacturing imprecision, or other deformation from exact geometric opposition and/or collinearity. Further, the horizontal frame member 930 is located farther distally, in the first direction 990 from the axial line 994 than the first horizontal support 912. In particular, the horizontal frame member 930 is located in the first direction 990 distal to the axial line 904 to a length sufficient to extend over target watercraft such as the large exemplary watercraft 104, moored as shown in FIGS. 1-4. Further, with reference to FIGS. 1-4, the horizontal frame member 930 may extend sufficiently far and the cantilever supports sufficiently elevated relative to the dock 100 and/or water level such that the defined barrel vault 980 offers enclosed access to the moored watercraft with entry via the entry gaps 913A or 933A, or via the vertical sides 981 and 982 of the barrel vault 980.

Referring still to the embodiment depicted in FIG. 9, the various components (vertical support 900, second horizontal support 914, cantilever support 920, and horizontal frame member 930) may be at least two in number and repeated an arbitrary number of times to comprise a canopy of any length. Specifically, the vertical supports 900 may support any number of first horizontal supports 912 and second horizontal supports 914 of any length and with any number of entry gaps 913A between two of the cantilever supports 920. Each entry gap 913A may be spanned by a third horizontal support 913 disposed in the entry gap 913A at a position higher than the second horizontal support 914 and affixed between any two of the cantilever supports 920. Similarly, first horizontal supports 12 and second horizontal supports 14 of arbitrary length can support an arbitrary number of evenly or unevenly spaced cantilever supports 920, which in turn support an arbitrary length and number of horizontal frame members 930. Multiple horizontal frame members 930 can support any number of outside entry gaps 933A, which may be spanned by a second horizontal frame member 933 at a position higher than the horizontal frame member 930 and affixed between any two of the cantilever supports 920.

Referring now to the vertical supports 900, in the embodiment depicted in FIG. 9, the vertical support 900 comprises a vertical member 901, a first vertical cantilever member 904, and a second vertical cantilever member 906. The vertical member 901 includes a vertical member upper joint 902. FIG. 13 provides a close up of the vertical member 901, the vertical member upper joint 902 with the first vertical cantilever member receiver 902A and the second vertical cantilever receiver 902B both affixed thereto. In the depicted embodiment, the first vertical cantilever member 904 inserts into or otherwise affixes to the first vertical cantilever member receiver 902A. The first vertical cantilever member may be retained in place frictionally by embedded bolt 902C (as shown in detail in FIG. 13) or other installed fastener in a manner analogous to that described in, above, with respect to the bracket vertical support tube 909C and in, below, with respect to frame connector fastener 1413. Where such embedded fasteners are used, the resulting joints may be understood as "slidable-lockable", for joints that allow the inserted member to slide within the joint and "rotatable-lockable" for joints that allow one inserted member to rotate with respect to another by rotating within the connector. Similarly, the second vertical cantilever member 906 inserts into of otherwise affixes to the second vertical cantilever member receiver 902B. In alternative embodiments, the vertical cantilever receivers 902A and 902B may be replaced in lieu of a monolithically manufactured component wherein the vertical member 901, first vertical cantilever member 904, and second vertical cantilever member 906 are all inline.

Referring still to the vertical supports 900, the first vertical cantilever member 904 includes a first upper support joint 905, which may join the first vertical cantilever member 904 to the first horizontal support 912. Similarly, the second vertical cantilever member 906 includes a second upper support joint 907, which may join the second vertical cantilever member 906 to the second horizontal support 914. In the depicted embodiment, the first vertical cantilever member 906 extends distally, in the first direction 990, from the axial line 994 of the vertical support 901. The second vertical cantilever member extends distally, in the second direction 992, from the axial line 994. In the context of the first and second vertical cantilever supports 904 and 906, the first direction 990 and second direction 992 are opposed, as defined above. Similarly, FIG. 9 defines a third direction and/or dimension 994, shown, by way of example only, in alignment with the second horizontal supports 914. The third direction 994 may be understood as simultaneously horizontal, perpendicular to both the first direction 990 and the second direction 992, and orthogonal to any vertical plane in which any cantilever support 920 defines an arc. Thus, any of the first horizontal supports 912, second horizontal supports 914, or horizontal frame members 930 may be understood as aligned and/or oriented in the third dimension 994, as shown. FIG. 13 provides a detail view of various sized and shaped vertical cantilever members; specifically a large vertical cantilever member 1320 and a small cantilever member 1321.

Referring still to the embodiment depicted in FIG. 9, the vertical cantilever members are arch shaped, as shown, in some embodiments, and can serve as the first vertical cantilever member 904 or second vertical cantilever member 906. In the depicted embodiment, the first vertical cantilever member 906 is shaped so as to define an arc that intersects the vertical member upper joint 902 and the first upper vertical support joint 905. Similarly, the second vertical cantilever member 904 is shaped so as to define an arc that intersects the vertical member upper joint 902 and the second upper vertical support joint 907. Such arcs may be understood as downwardly concave and lacking any inflection points, as shown. As used herein, "intersect" includes being affixed adjacently to, as in the distal right-angle frame connector 1404 and the distal receiver members 902A and 902B.

Figure 7B:
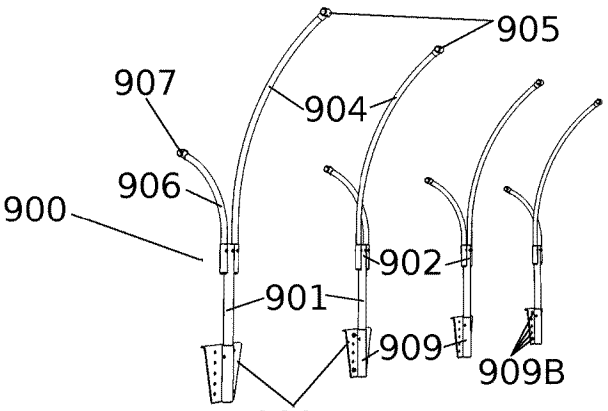
FIG. 7B is a front right perspective view of a portion of several vertical supports with cantilever members, in accordance with at least one embodiment of the invention.
Figure 7A:
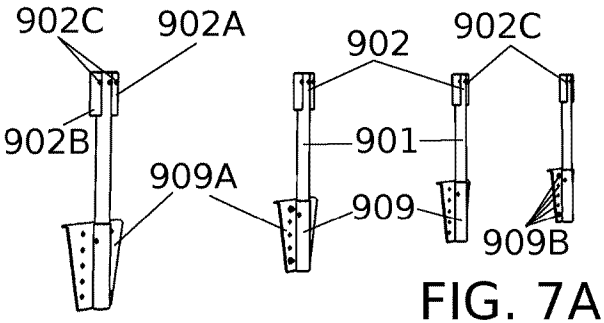
FIG. 7A is a front right perspective view of a portion of several vertical supports, in accordance with at least one embodiment of the invention.
Figure 7D:
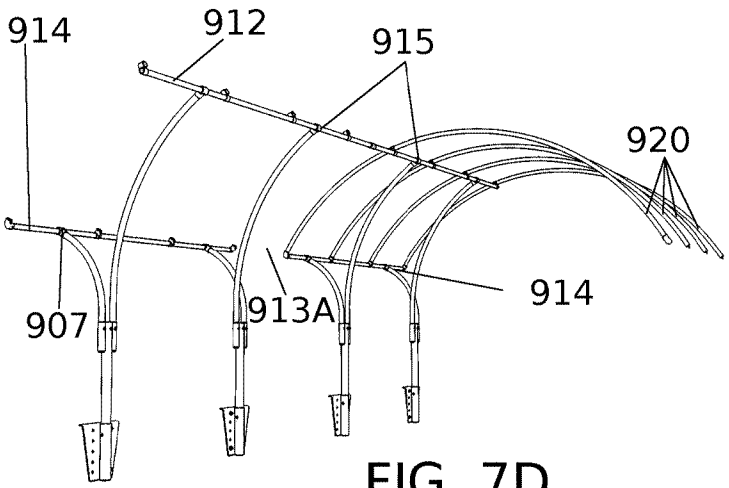
FIG. 7D is a front right perspective view of a portion of several vertical supports with cantilever members, horizontal supports, and cantilever supports, in accordance with at least one embodiment of the invention.
Figure 7C:
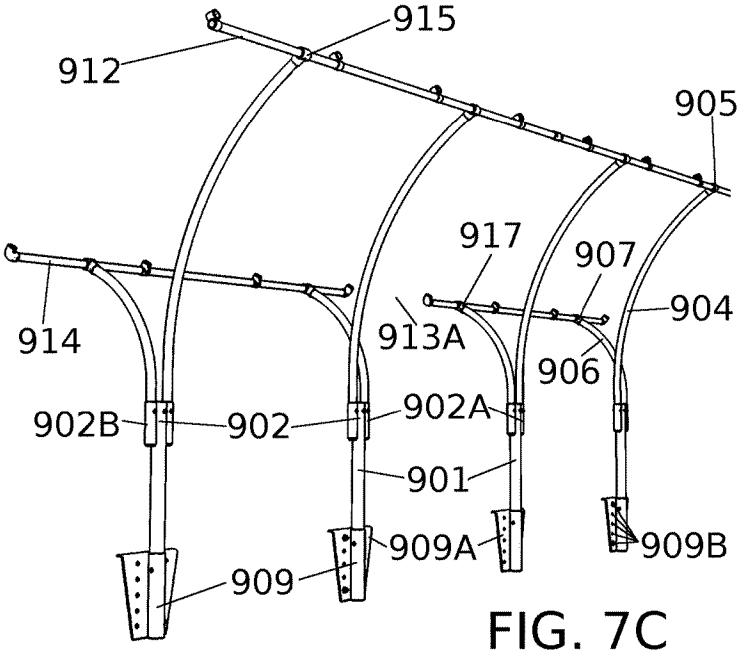
FIG. 7C a front right perspective view of a portion of several vertical supports with cantilever members and horizontal supports, in accordance with at least one embodiment of the invention.

FIGS. 7A, 7B, 7C, and 7C show a progression of canopy frame parts in advancing states of assembly. Specifically FIG. 7A demonstrates the vertical member 901 and bracket 909. FIG. 7B adds the first and second vertical cantilever members 904 and 606. FIG. 7C introduces the first and second horizontal supports 912 and 914. FIG. 7D adds the cantilever supports 920.

In various embodiments, connections between the elements of the canopy frame may be achieved by any known or later discovered means, and the elements of the canopy frame may be of any material or shape profile. However, in an embodiment, the structural elements, specifically the vertical members 901, the first vertical cantilever members 904, the second vertical cantilever members 906, the first horizontal supports 912, the second horizontal supports 914, the cantilever supports 920, and the horizontal frame members 930 are all made of galvanized steel pipe or beam, or alternative materials such as aluminum, composite, plastic, or wood. The frame elements may be manufactured to length or, in some embodiments, are assembled from short modular segments having male and female connectors such that the entire frame is easily transported, assembled, and stored. Those frame elements that are hollow are preferably pierced with weep holes providing for the drainage and evaporation of internally accumulated moisture.

Figure 14B:
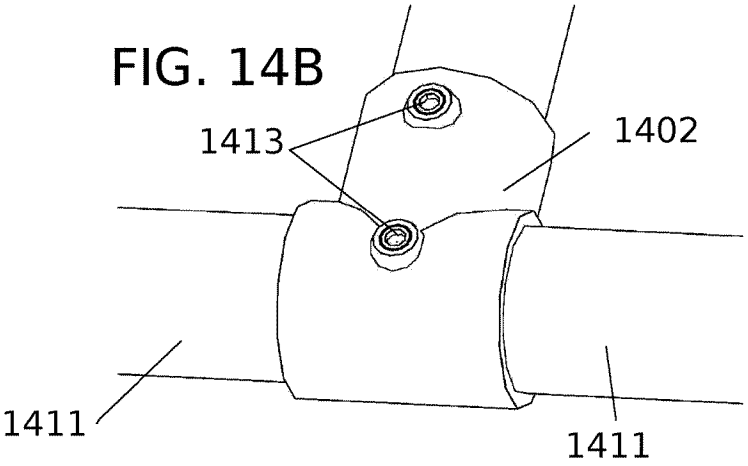
FIG. 14B is an elevated perspective view of a T-clamp element, in accordance with at least one embodiment of the invention.
Figure 14D:
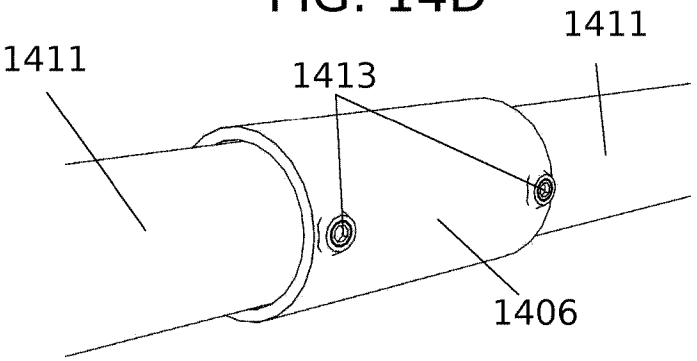
FIG. 14D is an elevated perspective view of a straight clamp, in accordance with at least one embodiment of the invention.
Figure 14A:
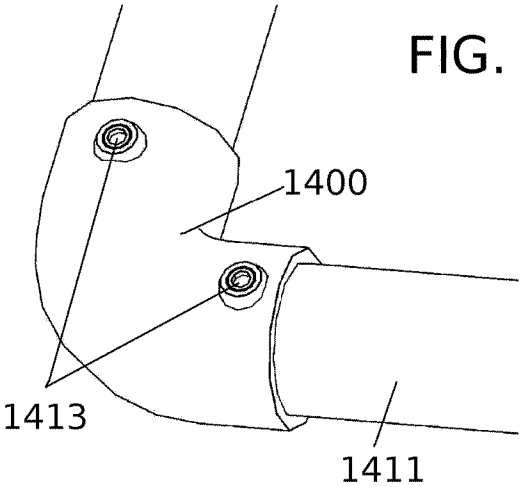
FIG. 14A is an elevated perspective view of a right-angle clamp element, in accordance with at least one embodiment of the invention.
Figure 14C:
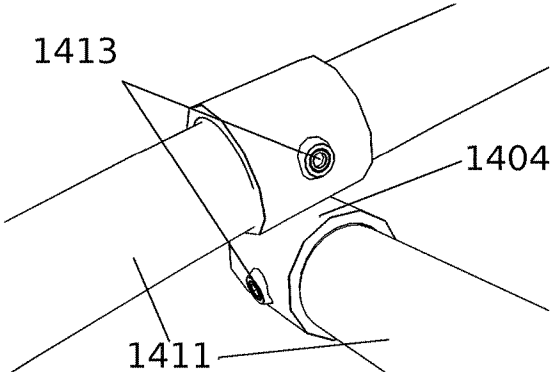
FIG. 14C is an elevated perspective view of a right-angle offset clamp, in accordance with at least one embodiment of the invention.

The connections between the aforementioned structural components may be formed with the pipe or beam connectors of FIGS. 14A-14D. A straight connector (FIG. 14D) 1413 may join two inline frame elements 1411 and secure each with a frame connector fastener 1413. Similarly, a right-angle connector 1400 (FIG. 14A) may join two frame elements 1411 and secure them via the same frame connector fastener 1413. Similarly, a T-connector 1402 (FIG. 14B) may join two or three (with a central joint) frame elements 1411 and secure them via the same frame connector fastener 1413. In FIG. 14C, a distal right-angle offset frame connector 1404 places two inline connectors at right angles and offset to form a 4-way connector that joins two or four frame elements 1411 (the offset allows for a single pipe or beam to be passed through) using the same frame fasteners 1413. The frame connector fastener 1413 may be formed from a welded nut within the frame connector 1400, 1402, 1404, or 1406 that is threaded with an Allen bolt. Referring still to the frame connectors 1400, 1402, 1404, and 1406, the Applicant has identified and applied commercially available Kee Klamp® brand connectors with success in the context of the present invention.

Figure 12:
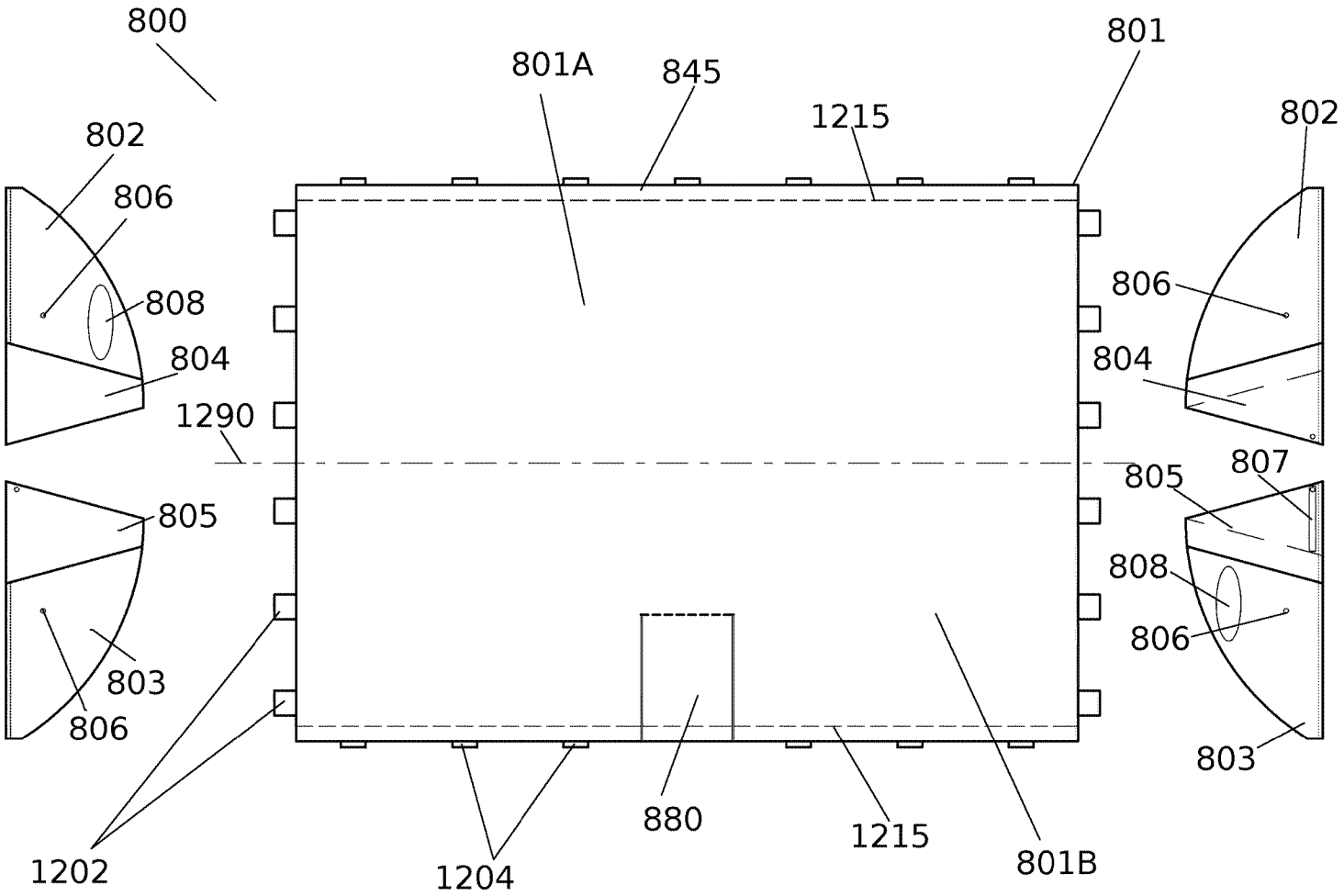
FIG. 12 is a plan view of a various components of a canopy cover, in accordance with at least one embodiment of the invention.

Referring now to the canopy cover 800, shown in disassembled plan view in FIG. 12, the preferred embodiment of the canopy comprises a canopy top element 801, which may be understood as divided into a first canopy top element half 801A and a second canopy top element half 801B, about a canopy centerline 1290. The canopy 800 may further include a pair of first canopy side elements 802, and a pair of second canopy side elements 803. Each of the first canopy side elements 802 is defined to have a first side element inner edge, a first side element bottom edge, and a first side element curved top edge. Similarly, each of the second canopy side elements 803 is defined to have a second side element inner edge, a second side element bottom edge, and a second side element curved top edge. The curved top edges are shaped to match the arc of the cantilever supports 920. The outside surface of the canopy side elements 802 and/or 803 may have affixed thereto a logo placement 808 whereon branding or other indicia may be printed. Additionally, the canopy top element 801 as well as the canopy side elements 802 and 803 may have affixed to their lower edges a loosely hanging skirt 845 of additional material, which may provide added protection against the entry of dirt, wind, and moisture. Together, the canopy top element 801 and canopy side elements 802 and 803 may be understood to form a canopy cover 800, which may be removably affixed to and substantially covering the at least one cantilever support 920, the at least one first horizontal support 912, the at least one second horizontal support 914, and the horizontal frame member 930.

The canopy components may be joined by canopy cover fasteners, which may be present along the first side element curved top edges and the second side element curved top edges. The canopy cover fasteners may take the form of stitching, zippers, hook and loop fastener strips, buttons, snaps, etc. Along the first and second side element top edges, the canopy cover fasteners form a side element top edge fastening means for fastening each of the first pair of side elements 802 and second pair of side elements 803, to the top element 800. In the case of the side elements 802 and 803, a non-removable fastening means, i.e. stitching, may be applied. Notably, the canopy top element 800 has, affixed to its outer edges, fastener loops1202 (ends) and 1204 (long edges), which accommodate the cantilever supports 920 and horizontal frame members 930/second horizontal supports 914, respectively.

Figure 5:
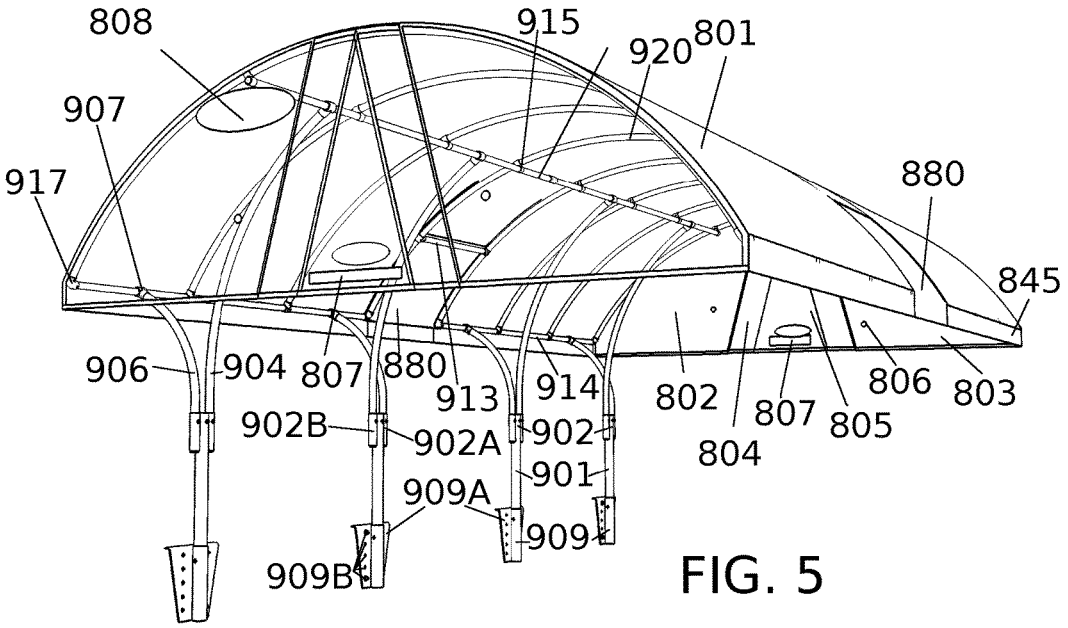
FIG. 5 is a lowered front right perspective view of a one-sided cantilevered watercraft canopy in isolation, with rollable door flaps down and front door flaps closed, in accordance with at least one embodiment of the present invention.
Figure 6:
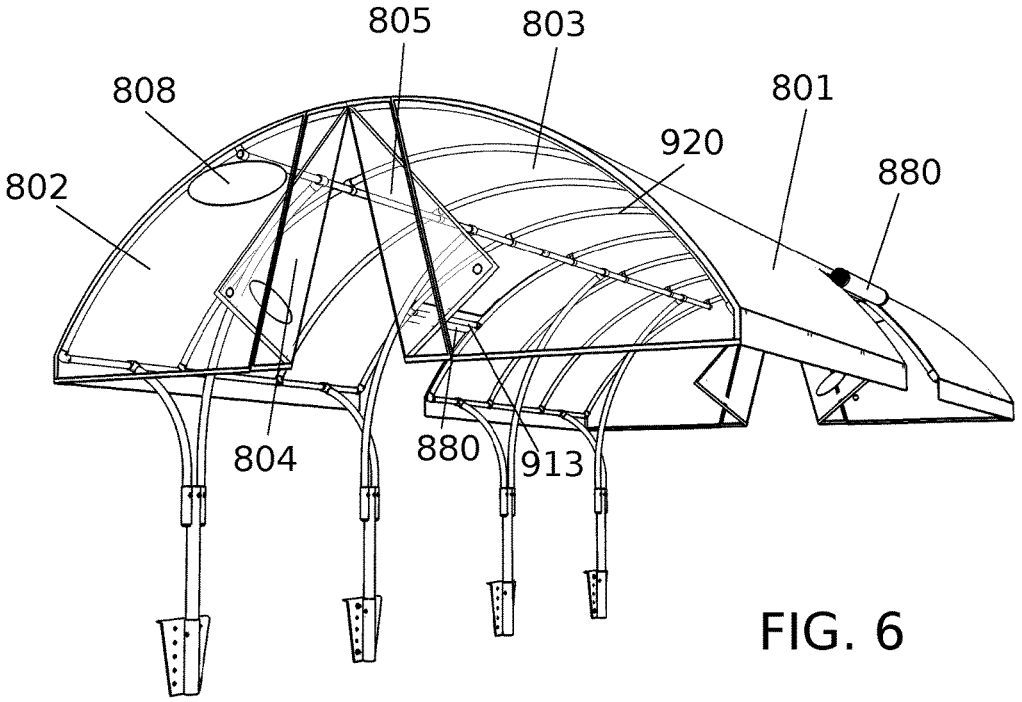
FIG. 6 is a lowered front right perspective view of a one-sided cantilevered watercraft canopy in isolation, with rollable door flaps up and front door flaps open, in accordance with at least one embodiment of the present invention.

Referring still to the canopy plan depicted in FIG. 12, the first side element 802 inner edges and the second side element 803 inner edges are removably joined by a side element fastening means for fastening the first pair of side elements 802 to the second pair of side elements 803. To achieve this means in its most generic form, canopy cover fasteners may be extended over the side element inner edges, which may be made parallel so as to be joined by a zipper, hook and loop fastener strip, buttons, snaps etc. However, in the depicted embodiment, the first side elements 802 and second side elements 803 are both shaped to have a first door flap 804 and second door flap 805, respectively, along their inner edges. The door flaps 804 and 805 may overlap and may be movable between a closed configuration, as shown in FIG. 5, and an open configuration, as shown in FIG. 6. In the closed configuration, a door closing fastener 807, which is present on the door flaps 804 and 805, may take the form of a hook and loop fastener strip, or alternatively buttons, snaps, hooks, etc.

Thus, in the depicted embodiment, the door closing fastener 807 provides the side element fastening means for fastening the first pair of side elements 802 to the second pair of side elements 803. Additionally, the door closing fastener 807 provides a detachable and reattachable closed door flap fastening means for fastening the first door flap 804 and the second door flap 805 in the closed configuration. Further, the door flaps 804 and 805 may be fastened in the open configuration of FIG. 6, provided the door opening fasteners 806, which may be snaps, buttons, hooks, hook and loop fasteners, etc. This forms a detachable and reattachable open configuration door flap fastening means for fastening the first door flap 804 and the second door flap 805 in the open configuration. The angled overlapping shape of the door flaps 804 and 805 provides fault-tolerance for deformation in the shape of the cantilever supports 920, horizontal frame members 930, first horizontal supports 912, second horizontal supports 914, and vertical supports 900, whether during manufacturing or after installation, for example due to deflection. As an alternative, the door flaps 804 and 805 may be replaced by a single roll-up or pull-up drapery style covering.

In addition to the door flaps 804 and 805, embodiments of the invention may include rollable door flaps 880 over the entry gaps 933A. The rollable door flaps 880 may be retained in a closed configuration (FIG. 5) by buttons, snaps, hook-and-loop fasteners, etc., or in an open configuration (FIG. 6) by straps, hook-and-loop fasteners, ties, etc.

Figure 8:
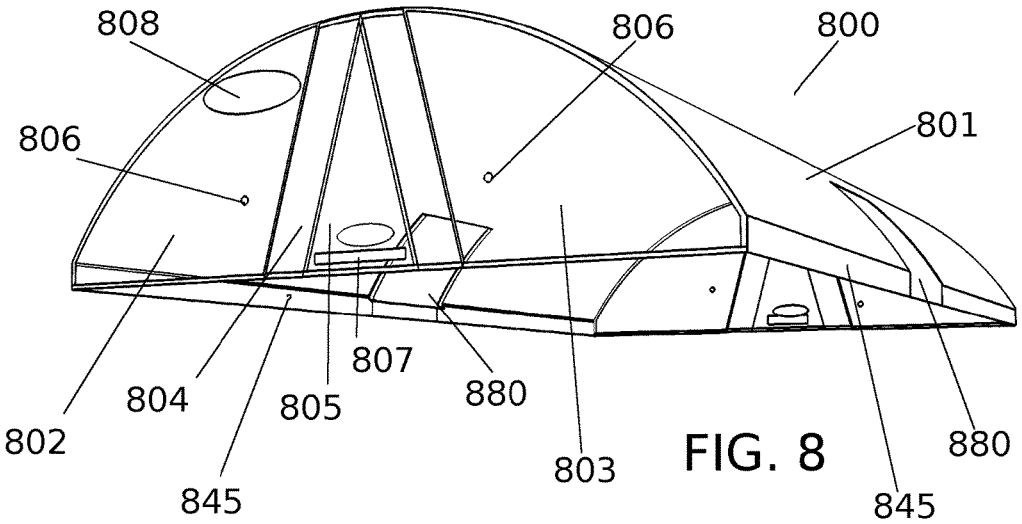
FIG. 8 is a lowered front right perspective view of a canopy cover, in accordance with at least one embodiment of the invention.

The canopy cover 800 and its sub-parts may be made from a waterproof or water resistant vinyl, canvas, or other fabric covering. In the depicted embodiment of FIG. 8, however, the canopy side elements 802 and 803, including the door flaps 804 and 805, may be made of a transparent material. For example, a transparent mesh fabric material or a clear vinyl material. FIGS. 1-6 display the transparency effect in scene view. The transparency allows light to enter such that the user can see the surrounding area during daylight via the side elements 802 and 803, and to see the contents of the canopy from outside or approaching persons or watercraft from inside, via the side elements 802 and 803 and door flaps 804 and 805.

Additionally, where a transparent mesh screening material is used, the structure has been observed to have superior air venting properties, which minimize air drag forces during storms and weather, and also allow for heat and moisture to be vented from the canopy interior. Additionally, the inventors have observed and/or recognized that the disclosed structure is unexpectedly resistant to high winds transverse to the canopy centerline 1290, which tend to roll over the aerodynamic arch structure, and to high winds along the canopy centerline 1290, which causes the door flaps 804 and 805 to blow out and then back in, releasing air pressure through the canopy and then resettling back to a closed configuration.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A cantilevered canopy structure, comprising:

(a) at least one vertical support;

(b) each said at least one vertical support comprising a first upper support joint and a second upper support joint;

(c) at least one first horizontal support;

(d) at least one second horizontal support;

(e) said first horizontal support being directly affixed to and supported by at least one of said at least one vertical support at said first upper support joint;

(f) said second horizontal support being directly affixed to and supported by at least one of said at least one vertical support at said second upper support joint;

(g) at least one cantilever support;

(h) said at least one cantilever support being directly affixed to and supported by both at least one of said at least one first horizontal support and at least one of said at least one second horizontal support;

(i) at least one horizontal frame member;

(j) said at least one horizontal frame member being affixed to and supported by at least one of said at least one cantilever support at a cantilever frame joint;

(k) said first upper support joint being distal, in a first direction, from an axial line of said at least one vertical support;

(l) said second upper support joint being distal, in a second direction, from said axial line, said first direction and said second direction being opposed such that said first direction and said second direction are both aligned in a transverse dimension of said cantilevered canopy structure and said at least one vertical support is physically aligned in said transverse dimension; and (m) said at least one horizontal frame member being located farther distally, in said first direction from said axial line than said first horizontal support (n) said least one vertical support comprises a vertical member, a first vertical cantilever member, and a second vertical cantilever member;

(o) said vertical member comprising a vertical member upper joint;

(p) said first vertical cantilever member and said second vertical cantilever member being slidably-lockably affixed to said vertical member at said vertical member upper joint so as to be adjustable in a substantially vertical dimension;

(q) said first vertical cantilever member being slidably-lockably and rotatably-lockably affixed to said first upper support joint;

(r) said second vertical cantilever member being rotatably-lockably affixed to said second upper support joint; and (s) said first upper support joint being vertically higher than said second upper support joint.

2. The cantilevered canopy structure of claim 1, wherein at least one structural element selected from the group consisting of: (i) said at least one first horizontal support; (ii) said at least one second horizontal support; and (iii) said at least one horizontal frame member is oriented along a third direction, said third direction being perpendicular to said first direction and said second direction.

3. The cantilevered canopy structure of claim 1, wherein said at least one cantilever support is shaped so as to define a downwardly concave arc that intersects said first horizontal support, said second horizontal support, and said horizontal frame member.

4. The cantilevered canopy structure of claim 3, wherein said downwardly concave arc defines a barrel vault, said barrel vault being extended lengthwise in a third direction, said third direction being horizontal and perpendicular to said first direction and said second direction, and said at least one first horizontal support, said at least one second horizontal support, and said at least one horizontal frame member defining the length of said barrel vault.

5. The cantilevered canopy structure of claim 4, wherein said at least one vertical support is nonrotatably affixed to a watercraft dock via a bracket, and said watercraft dock is adjacent, in said first direction, to a watercraft mooring area.

6. The cantilevered canopy structure of claim 5, wherein said barrel vault extends in said first direction over said watercraft mooring area.

7. The cantilevered canopy structure of claim 5, wherein said bracket comprises a bracket vertical support tube affixed to a bracket flat, and said at least one vertical support is inserted into said bracket vertical support tube.

8. The cantilevered canopy structure of claim 1, wherein said at least one cantilever support is affixed to a first horizontal support at a first cantilever support joint and to a second horizontal support at a second cantilever support joint, said first cantilever support joint being distinct from said first upper support joint and said second cantilever support joint being distinct from said second upper support joint.

9. A vertical support for a cantilevered canopy, comprising:

(a) a vertical member;

(b) a first vertical cantilever member;

(c) a second vertical cantilever member;

(d) said vertical member comprising a vertical member upper joint;

(e) said first vertical cantilever member and said second vertical cantilever member being slidably-lockably affixed to said vertical member at said vertical member upper joint so as to be adjustable in a substantially vertical dimension;

(f) said first vertical cantilever member comprising a first upper support joint comprising a tubular T-connector;

(g) said second vertical cantilever member comprising a second upper support joint comprising a tubular T-connector;

(h) said first vertical cantilever member extending distally, in a first direction, from an axial line of said at least one vertical support;

(i) said second vertical cantilever member extending distally, in a second direction, from said axial line, said first direction and said second direction being opposed and said first and second vertical cantilever members being physically aligned along a dimension comprising said first direction and said second direction;

(j) said first vertical cantilever member being shaped so as to define a first downwardly concave arc that intersects said vertical member upper joint and said first upper vertical support joint;

(k) said second vertical cantilever member is shaped so as to define a second downwardly concave arc that intersects said vertical member upper joint and said second upper vertical support joint; and (l) at least one of said first vertical support joint and said second vertical support joint being configured for supporting a horizontal member oriented in a third direction, said third direction being both horizontal and perpendicular to both said first direction and said second direction.

10. The vertical support for a cantilevered canopy of claim 9, wherein said first upper support joint is affixed directly to and supports a first horizontal support and said second upper support joint is affixed directly to and supports a second horizontal support, and said first horizontal support and said second horizontal support are oriented in said third direction, wherein said first upper support joint is located higher than said second upper support joint.

11. The vertical support for a cantilevered canopy of claim 10, further comprising at least one third cantilever member that is affixed directly to and supported by said first horizontal support at a first cantilever support joint and said second horizontal support at a second cantilever support joint; wherein said first cantilever support joint is distinct from said first upper support joint and said second cantilever support joint is distinct from said second upper support joint.

12. The vertical support for a cantilevered canopy of claim 9, wherein said vertical member upper support joint comprises a first vertical cantilever receiver affixed to said vertical support distally in said first direction and a second vertical cantilever receiver affixed to said vertical support distally in said second direction; and both said first vertical cantilever receiver and said second cantilever receiver comprise vertically oriented tubular members configured for receiving and retaining said first vertical cantilever member and said second vertical cantilever member, respectively.

13. The cantilevered canopy structure of claim 9, further comprising a bracket, said bracket comprising a bracket vertical support tube affixed to a bracket flat, and said vertical member being inserted into said bracket vertical support tube.

14. A barrel vault canopy frame, comprising:

a plurality of cantilever members, each having a cantilever member first end, a cantilever member second end, and a cantilever member central region;

each of said plurality of cantilever members defining a downwardly concave arc;

said plurality of cantilever members being oriented in parallel vertical planes aligned in a transverse dimension and arranged in a longitudinal dimension that is horizontal and orthogonal to said parallel vertical planes such that said plurality of cantilever members define a barrel vault aligned to said transverse and longitudinal dimensions;

said plurality of cantilever members being cylindrical in cross section;

a first horizontal member, cylindrical in cross section, oriented in said longitudinal dimension and supporting at least two of said plurality of cantilever members and slidably-lockably and rotatably-lockably affixed, at a cantilever member upper support joint in said cantilever member central region, by insertion of said cantilever member and said first horizontal member into a tubular distal right-angle offset frame connector;

a second horizontal member, cylindrical in cross section, oriented in said longitudinal dimension and supporting at least two of said plurality of cantilever members and slidably-lockably and rotatably-lockably affixed, at a cantilever member lower support joint located at said cantilever member first end, by insertion of said cantilever member and said second horizontal member into a tubular right-angle connector and/or a tubular T-connector;

at least one vertical support comprising: (i) a vertical member located, in said transverse dimension, between said first and second horizontal members, and, in said longitudinal dimension, offset from said first upper support joint and said second upper support joint, (ii) affixed to said vertical member at said vertical member top end, first and second tubular receivers, said first and second tubular receivers being oriented vertically and substantially parallel to said vertical member, (iii) a first vertical support member having a first vertical support member vertical lower region and a first vertical support member arched upper region, said first vertical support member vertical lower region being inserted into and slidably-lockably retained within said first vertical tubular member receiver, (iv) a second vertical support member having a second vertical support member vertical lower region and a second vertical support member arched upper region, said second vertical member vertical lower region being inserted into and slidably-lockably retained within said second tubular member receiver, (v) said first vertical support member upper arch region being oriented distally from said vertical member in said transverse direction toward said first horizontal member and terminating in a tubular T-connector slidably-lockably affixed about said first horizontal member, (vi) said second vertical support member upper arch region being oriented, in said transverse dimension, toward said second horizontal member and terminating in a tubular T-connector slidably-lockably affixed about said second horizontal member.

15. The barrel vault canopy frame of claim 14, wherein each of said plurality of vertical supports is nonrotatably affixed to a watercraft dock via a bracket, said watercraft dock being adjacent to a watercraft mooring area.

16. The barrel vault canopy frame of claim 15, wherein said bracket comprises a bracket vertical support tube affixed to a bracket flat, and said at least one vertical support is inserted into said bracket vertical support tube.

17. A cantilevered canopy structure, comprising:

a first vertical cantilever member and a second vertical cantilever member slidably-lockably affixed to a vertical member at a vertical member upper joint so as to be adjustable in a substantially vertical dimension;

said first vertical cantilever member being slidably-lockably and rotatably-lockably affixed to a first upper support joint;

said second vertical cantilever member being rotatably-lockably affixed to a second upper support joint;

a first horizontal support affixed to said first vertical cantilever member at said first upper support joint;

a second horizontal support affixed to said second vertical cantilever member at said second upper support joint;

at least one cantilever support affixed to both said first horizontal support and said second horizontal support;

at least one horizontal frame member affixed to at least one of said at least one cantilever support at a cantilever frame joint.

* * * * *